US012667141B2

(12) United States Patent
Pennington

(10) Patent No.: US 12,667,141 B2
(45) **Date of Patent: *Jun. 30, 2026**

(54) SUPPORT GARMENT

(71) Applicant: NIKE, Inc., Beaverton, OR (US)

(72) Inventor: Tara L. Pennington, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/642,461

(22) Filed: Apr. 22, 2024

(65) Prior Publication Data

US 2024/0268487 A1 Aug. 15, 2024

Related U.S. Application Data

(63) Continuation of application No. 17/343,197, filed on Jun. 9, 2021, now Pat. No. 11,969,027.

(60) Provisional application No. 63/061,977, filed on Aug. 6, 2020.

(51) Int. Cl.
*A41C 3/00* (2006.01)
*A41C 3/12* (2006.01)

(52) U.S. Cl.
CPC ..... *A41C 3/0014* (2013.01); *A41C 3/0057* (2013.01); *A41C 3/128* (2013.01)

(58) Field of Classification Search
CPC ..... A41C 3/0014; A41C 3/0057; A41C 3/128
See application file for complete search history.

(56) References Cited

U.S. PATENT DOCUMENTS 4,217,905 A * 8/1980 Atwater ..... A41C 3/0057 450/74
4,340,064 A 7/1982 Vale
4,781,651 A 11/1988 Ekins
(Continued)

FOREIGN PATENT DOCUMENTS

CN 103300490 A 9/2013
EP 2792257 A1 10/2014
(Continued)

OTHER PUBLICATIONS

Office Action received for Canadian Patent Application No. 3189469, mailed on May 17, 2024, 3 pages.
(Continued)

*Primary Examiner* — Khoa D Huynh
*Assistant Examiner* — Erick I Lopez
(74) *Attorney, Agent, or Firm* — SHOOK, HARDY & BACON L.L.P.

(57) ABSTRACT

Aspects herein are directed to a support garment that includes a number of features configured to provide a high level of support to a wearer's breasts while being comfortable to wear. The support garment includes a Y-shaped layer affixed to an inner surface of a front portion of the support garment that helps to limit upward movement of a wearer's breasts. The support garment also includes foam pads having a uniform thickness and a plurality of apertures located at side portions of the support garment and configured to limit lateral movement of the wearer's breasts. The support garment also includes an underband that is zoned to be breathable and permeable at a front center of the underband while still providing support to an under portion of the wearer's breasts.

20 Claims, 10 Drawing Sheets

(56) References Cited

U.S. PATENT DOCUMENTS

| | | | | |
|---|---|---|---|---|
| D301,518 | S | 6/1989 | Schreiber-Miller et al. | |
| D302,761 | S | 8/1989 | Akazaki | |
| D316,322 | S | 4/1991 | Bosler et al. | |
| D321,083 | S | 10/1991 | Thygesen | |
| 5,211,598 | A | 5/1993 | Hall | |
| D403,486 | S | 1/1999 | Chetwynd | |
| 6,068,538 | A | 5/2000 | Alleyne | |
| 6,083,079 | A | 7/2000 | Pearson | |
| 6,805,611 | B2 | 10/2004 | Luk | |
| 7,214,120 | B2 | 5/2007 | Kaye et al. | |
| 7,435,155 | B2 | 10/2008 | Reinisch et al. | |
| 7,442,110 | B2 | 10/2008 | Gaudet et al. | |
| 8,257,138 | B2 | 9/2012 | Smith | |
| 8,439,721 | B2 | 5/2013 | Sokolowski et al. | |
| 8,777,693 | B2 | 7/2014 | Shashy | |
| 8,915,764 | B2 | 12/2014 | Scott et al. | |
| D798,535 | S | 10/2017 | Mcmanus | |
| D821,703 | S | 7/2018 | Flower et al. | |
| 10,051,896 | B2 | 8/2018 | Miller et al. | |
| D830,037 | S | 10/2018 | Staub | |
| 10,201,192 | B1 * | 2/2019 | Lott | A41C 3/02 |
| 10,334,891 | B2 * | 7/2019 | Weber-Unger | A41C 3/12 |
| 10,448,679 | B1 | 10/2019 | Roddis et al. | |
| D865,325 | S | 11/2019 | Carpenter et al. | |
| 2002/0022433 | A1 | 2/2002 | Yeung et al. | |
| 2005/0085160 | A1 | 4/2005 | Johnstone | |
| 2009/0081924 | A1 | 3/2009 | Puyaubreau | |
| 2011/0117818 | A1 | 5/2011 | Barnard | |
| 2012/0122370 | A1 * | 5/2012 | Heath | A41C 3/0057 450/80 |
| 2012/0244782 | A1 * | 9/2012 | Pundyk | A41C 3/0057 450/70 |
| 2015/0111466 | A1 * | 4/2015 | Martinet | A41C 3/065 450/41 |
| 2017/0099884 | A1 * | 4/2017 | Martinet | A41C 3/10 |
| 2017/0245556 | A1 | 8/2017 | Ward et al. | |
| 2017/0290376 | A1 | 10/2017 | Maheshwari et al. | |
| 2017/0360118 | A1 | 12/2017 | Randall et al. | |
| 2018/0242653 | A1 | 8/2018 | Brandt et al. | |
| 2019/0104772 | A1 | 4/2019 | Mike | |
| 2019/0174840 | A1 | 6/2019 | Paulson | |
| 2020/0037673 | A1 * | 2/2020 | Storelli | A41C 3/0057 |

FOREIGN PATENT DOCUMENTS

| | | | |
|---|---|---|---|
| EP | 3087854 | A1 | 11/2016 |
| EP | 3284356 | A1 | 2/2018 |
| JP | 3175705 | U | 5/2012 |
| WO | 2011/105635 | A1 | 9/2011 |
| WO | 2013/088280 | A1 | 6/2013 |
| WO | 2015/002589 | A1 | 1/2015 |
| WO | 2017/079393 | A1 | 5/2017 |
| WO | 2018/193270 | A1 | 10/2018 |

OTHER PUBLICATIONS

3 Pack Women Racerback Sports Bras High Impact Workout Yoga Gym Fitness Bra, Amazon, Available online at: <www.amazon.com>, ASIN: B07JVSTC6R, Jan. 1, 2019, 9 pages.

Air Control Deltapad—Maximum Support Sports Bra, Anita, Available online at: <www.anita.com>, Article#: 5544, Sep. 27, 2019, 5 pages.

Bowles et al., "Features of sports bras that deter their use by Australian women", Journal of Science and Medicine in Sport, vol. 15, Issue 3, Available online at: <www.sciencedirect.com>, May 2012, pp. 195-200.

Icebreaker Meld Zone Sports Bra, REI, Available online at: <www.rei.com>, Item #127723, Feb. 3, 2020, 5 pages.

Lorentzen et al., "Selected Sports Bras: A Biomechanical Analysis of Breast Motion While Jogging", The Physician and Sportsmedicine, ISSN: 0091-3847, Available online at: <http://www.tandfonline.com/loi/ipsm20>, 1987, pp. 128-139.

Nolte et al., "The effectiveness of a range of sports bras in reducing breast displacement during treadmill running and two-step star jumping", J Sports Med Phys Fitness, Nov. 2016;56{11), Jan. 14, 2016, pp. 1311-1317.

Scurr et al., "The effect of breast support on the kinematics of the breast during the running gait cycle", Journal of Sports Sciences, 28:10, Available online at :<https://doi.org/10.1080/02640414.2010.497542>, 2010, pp. 1103-1109.

Syrokan Women's Workout Sports Bra, Amazon, Available online at: <https://www.amazon.in>, ASIN: B0814B4X4R, Nov. 7, 2019, 10 pages.

Tyler et al., "Recent advances in garment manufacturing technology: joining techniques, 3D body scanning and garment design", The Global Textile and Clothing Industry, Technological Advances and Future Challenges, Woodhead Publishing Series in Textiles, 2012, pp. 131-170.

Victoria's Secret Lightweight Mesh Band Sports Bra, Amazon.com, Available online at: <www.amazon.com>, ASIN: B07P978JFW, Feb. 28, 2019, 4 pages.

Notice of Allowance received for Canadian Patent Application No. 3189469, mailed on Jul. 30, 2025, 1 page.

Extended European Search Report received for European Patent Application No. 25204519.0, mailed on Dec. 4, 2025, 8 pages.

* cited by examiner

SUPPORT GARMENT

CROSS-REFERENCE TO RELATED APPLICATIONS

This application having Ser. No. 18/642,461 and titled "Support Garment" is a continuation application of U.S. application Ser. No. 17/343,197, entitled "Support Garment" and filed Jun. 9, 2021. U.S. application Ser. No. 17/343,197 claims the benefit of priority of U.S. App. No. 63/061,977, filed Aug. 6, 2020, and titled "Support Garment." The entirety of the aforementioned applications are incorporated by reference herein.

TECHNICAL FIELD

Aspects herein are directed to a support garment in the form of a bra that includes features that provide a high level of support to a wearer's breasts while still being comfortable to wear.

BACKGROUND

Constructing a support garment, such as a bra, so that it provides a high level of support during athletic activities is challenging. Traditional sport bras that attempt to provide this level of support generally do so through the application of high amounts of compression, which can be uncomfortable to a wearer.

BRIEF DESCRIPTION OF THE DRAWINGS

Examples of aspects herein are described in detail below with reference to the attached drawing figures, wherein.

DETAILED DESCRIPTION

Figure 1:
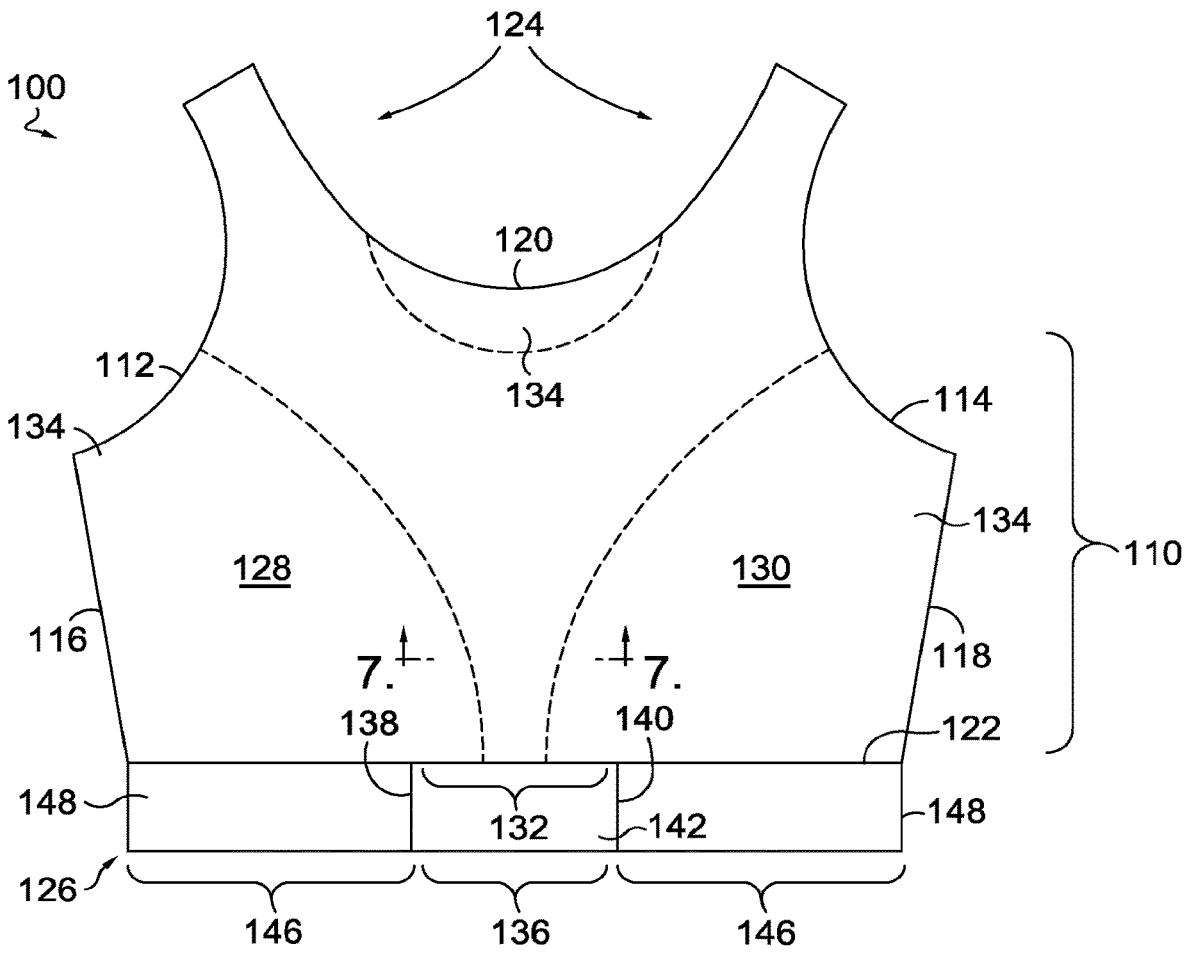
FIG. 1 illustrates a view of an outer-facing surface of a front portion of a support garment in accordance with aspects herein.

The subject matter of the present invention is described with specificity herein to meet statutory requirements. However, the description itself is not intended to limit the scope of this disclosure. Rather, the inventors have contemplated that the claimed or disclosed subject matter might also be embodied in other ways, to include different steps or combinations of steps similar to the ones described in this document, in conjunction with other present or future technologies. Moreover, although the terms "step" and/or "block" might be used herein to connote different elements of methods employed, the terms should not be interpreted as implying any particular order among or between various steps herein disclosed unless and except when the order of individual steps is explicitly stated.

Traditional support garments that provide a high level of support during, for example, sport activities, typically do so by the application of high amounts of compression to a wearer's breasts which may prevent any type of natural movement of the wearer's breasts. This may be uncomfortable to the wearer. Aspects herein are directed to a support garment, such as a bra, that includes features that provide a high amount of support and control to a wearer's breasts while still allowing for some movement which facilitates wearer comfort. For example, the support garment may include a Y-shaped layer affixed to an inner-facing surface of a front portion of the support garment. The Y-shaped layer is formed from a mesh material that exhibits stretch and has a high modulus of elasticity or a high degree of stretch resistance (known in the textile industry as "power mesh"). The Y-shaped layer includes an upper right portion and an upper left portion that converge to form a lower central portion. The upper right portion and the upper left portion are generally positioned superior or above breast covering areas of the front portion while the lower central portion is positioned between the breast covering areas. A terminal end of the lower central portion may be affixed to an underband and/or a lower margin of the support garment. In use, the upper right portion and the upper left portion are designed to limit upward movement of the wearer's breasts, and the lower central portion acts as an anchor to stabilize the upper right portion and the upper left portion of the Y-shaped layer.

The support garment may further include foam pads that are positioned at the side portions of the support garment. In example aspects, the foam pads may be thin having a uniform thickness from about 0.5 mm to about 2.5 mm and may include a plurality of apertures uniformly distributed on the foam pad. Each foam pad includes a leading edge that abuts lateral edges of the front portion and a trailing edge that is spaced apart from the lateral edges of the front portion. The positioning and the thin profile of the foam pads help to stabilize lateral movement of the wearer's breasts while still allowing some movement which facilitates wearer comfort. The apertures and the thin profile of the pads helps to make them lightweight and breathable.

The support garment may additionally include an underband that is zoned based on, for example, heat and/or sweat maps of the human body. In one example, the underband includes a first area that is positioned at the center front of the support garment. The first area may include a lightweight mesh material having a high degree of air permeability and a high degree of stretch resistance in the longitudinal direction. Heat and/or sweat maps indicate that this area is a high heat and/or sweat producing area; thus, having a highly permeable mesh material in this location facilitates sweat evaporation and cooling. The high degree of stretch resistance in this area of the underband may help support the wearer's breasts. The underband may further include a second area that may comprise the remaining portion of the underband. The second area may include an elastic mesh material that has a smaller degree of stretch resistance (i.e., more easily stretched) in the longitudinal direction than the mesh material in the first area and a lower air permeability than the mesh material in the first area. The smaller degree of stretch resistance may facilitate donning and doffing the support garment and may also make the support garment more comfortable to wear during certain movements, particularly athletic movements. The lower air permeability of the second area reflects that, for instance, the sides of a wearer's torso may be a relatively low heat and/or sweat producing area as compared to the center front of the wearer's torso.

The term "support garment" as used herein is meant to be construed broadly to cover any type of support garment configured to cover, provide support, and/or provide modesty to a wearer's breasts. Thus, the term support garment may include a traditional bra, a sport bra, a bandeau, a camisole, a swimsuit, and the like. The term "breast covering area" when used in relation to a support garment means the portion of the support garment that substantially or entirely covers respective right and left breasts of a wearer. The breast covering area may include a molded cup or it may include a non-molded cup.

Positional or directional terms used to describe the support garment such as front, back, sides, interior, inner, outer, innermost, right, left, central, medial, lateral, upper or superior, lower, leading, trailing, and the like refer to the garment being worn as intended by a wearer standing upright. Thus, the term "front" or "front portion" means configured to cover an upper front torso area of a wearer including the breast area, and the term "back" or "back portion" means configured to cover an upper back torso area of a wearer. The term "side" or "side portion" means configured to cover a side torso area of a wearer including the underarm area of the wearer. The term "interior" and/or "inner" means positioned closer to a body surface of a wearer with respect to another structure or layer of the support garment. The term "innermost" means a layer or structure that is positioned closest to a body surface of a wearer with respect to another structure or layer of the support garment. The term "outer" means positioned farther away from a body surface of a wearer with respect to another structure or layer of the support garment. The term "right" means positioned on a right side of a wearer's body, and the term "left" means positioned on a left side of the wearer's body when the support garment is worn. The term "central" means located generally along a vertical midline of a wearer's body. The term "medial" means located closer to a midline of the garment or a wearer wearing the garment, and the term "lateral" means located closer to a side of the support garment or a wearer wearing the garment. The term "upper" or "superior" means located closer to a head area of a wearer, and the term "lower" means located closer to a foot area of the wearer. The term "leading" or "leading edge" means a front edge of a structure such as a foam pad or a side portion, and the term "trailing" or "trailing edge" means a rear or back edge of a structure such as a foam pad or a side portion of the support garment.

The term "elastic yarns" as used herein means a yarn that exhibits stretch and recovery characteristics. For example, an elastic yarn may be stretched to 100% or even 200% of its original length in response to a tension force and generally returns to its original length when the tension force is removed. Example elastic yarns include, for example, spandex yarns. The term "mesh" as used herein means a textile (knit, woven, or nonwoven) with a comparatively open structure (i.e., a structure with a large amount of holes). The open structure may be engineered through, for instance, a knitting process, a weaving process, or a nonwoven formation process, and/or the open structure may be formed in a post-production step by forming the holes using, for example, a cutting process, a lasering process, and the like.

The term "about" as used herein to refer to numerical values means within ±10% of the indicated value unless otherwise indicated. Unless otherwise noted, all measurements provided herein are measured when the support garment is at standard ambient temperature and pressure (25 degrees Celsius or 298.15 K and 1 bar) and is in a resting (e.g., un-stretched) state.

Figure 2:
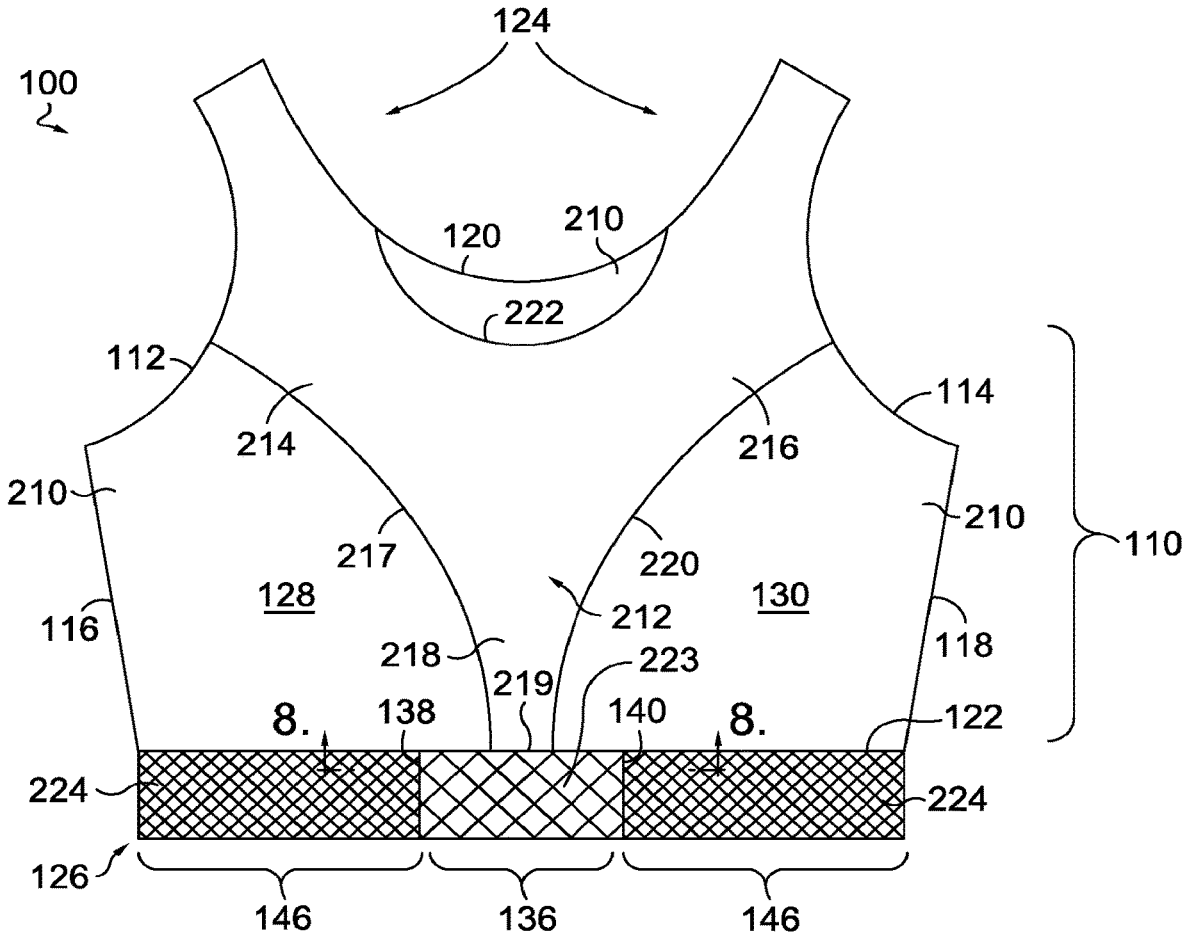
FIG. 2 illustrates a view of an inner-facing surface of the front portion of FIG. 1 in accordance with aspects herein.

FIG. 1 illustrates a view of an outer-facing surface of a front portion 110 of a support garment 100 in the form of a bra, and FIG. 2 illustrates a view of an inner-facing surface of the front portion 110 of the support garment 100. The front portion 110 generally extends from a first armhole edge 112 to a second armhole edge 114, from a first front lateral edge 116 to a second front lateral edge 118, and from a neckline edge 120 to a lower edge 122. In example aspects, and as explained further below, the first front lateral edge 116 and the second front lateral edge 118 may comprise a seamed edge where the front portion 110 is joined to side portions of the support garment 100, or the first front lateral edge 116 and the second front lateral edge 118 may comprise a hypothetical boundary demarcating the limits of the front portion 110. Shoulder straps 124 extend from the upper part of the front portion 110, and an underband 126 extends from the lower edge 122 of the front portion 110. The front portion 110 includes a first breast covering area 128 configured to substantially cover a right breast of a wearer and a second breast covering area 130 configured to substantially cover a left breast of a wearer when the support garment 100 is in an as-worn configuration. A central area 132 of the front portion 110 (shown in FIG. 1) is located between the first breast covering area 128 and the second breast covering area 130.

As shown in FIG. 1, the front portion 110 includes an outer layer 134 that continuously extends from the first armhole edge 112 to the second armhole edge 114, from the first front lateral edge 116 to the second front lateral edge 118, and from the neckline edge 120 to the lower edge 122. In example aspects, the outer layer 134 may comprise a single panel of material without seams. In other example aspects, the outer layer 134 may comprise two or more panels of material joined together at seams that, together, form the outer layer 134. In example aspects, the outer layer 134 may be a single-knit jersey material. The use of a single-knit jersey material as opposed to, for instance, a double-knit material creates a clean, low-profile, lightweight, outer-facing surface for the support garment 100. In example aspects, the single-knit jersey material may be formed from polyester yarns and elastic yarns. The elastic yarns provide a degree of stretch and recovery to the outer layer 134 which helps to provide support and facilitates donning and doffing the support garment 100. As explained further below, the front portion 110 also includes a Y-shaped layer, shown in dashed lines to indicate that it is generally hidden from view by the outer layer 134, which is positioned on an inner-facing surface of the support garment 100.

The support garment 100 further includes an inner layer 210 shown in FIG. 2. The inner layer 210 continuously extends from the first armhole edge 112 to the second armhole edge 114, from the first front lateral edge 116 to the second front lateral edge 118, and from the neckline edge 120 to the lower edge 122. In example aspects, the inner layer 210 may comprise a single panel of material without seams. In other example aspects, the inner layer 210 may comprise two or more panels of material joined together at seams that, together, form the inner layer 210. In example aspects, the inner layer 210 may comprise a double-knit material and/or a double-knit spacer material. The use of a double-knit material and/or a double-knit spacer material helps to provide modesty and also helps to provide an increased level of compression due to the presence of two interknit layers. In example aspects, the double-knit material and/or the double-knit spacer material may be formed from nylon yarns and elastic yarns. The elastic yarns provide a degree of stretch and recovery to the inner layer 210 and aid in compression. The use of nylon yarns with their low moisture regain facilitates the transport of moisture away from the wearer's skin due to, for example, capillary action between the yarns and/or the filaments forming the yarns.

In example aspects, the inner layer 210 and the outer layer 134 may have substantially the same shape such that they collectively form the first armhole edge 112, the second armhole edge 114, the first front lateral edge 116, the second front lateral edge 118, the neckline edge 120, and the lower edge 122. In example aspects, the inner layer 210 may be substantially unaffixed from the outer layer 134. For example, the inner layer 210 may only be affixed to the outer layer 134 at the perimeter edges of the respective layers (e.g, at the neckline edge 120, the lower edge 122, the first and second armhole edges 112 and 114, and/or the first and second front lateral edges 116 and 118) leaving a majority (e.g., greater than about 90%) of the respective surfaces of the inner layer 210 and the outer layer 134 unaffixed so that the inner layer 210 may slide relative to the outer layer 134 which may facilitate wearer comfort and aid in donning and doffing.

FIG. 2 further depicts a Y-shaped layer 212 affixed to the inner layer 210. In example aspects, an entirety of the Y-shaped layer 212 is affixed to the inner layer 210. Stated differently, the entire surface of the Y-shaped layer 212 that is in contact with the inner layer 210 is affixed to the inner layer 210. Thus, in example aspects, the Y-shaped layer 212 may, along with portions of the inner layer 210 not covered by the Y-shaped layer 212, form an innermost surface of the support garment 100. The Y-shaped layer 212 includes an upper right portion 214, an upper left portion 216, and a lower central portion 218. A right edge 217 extends between the upper right portion 214 and the lower central portion 218, and a left edge 220 extends between the upper left portion 216 and the lower central portion 218. As shown, the right edge 217 and the left edge 220 converge toward each other as they extend toward the lower central portion 218. The Y-shaped layer 212 may also include an upper edge 222 that extends between the upper right portion 214 and the upper left portion 216. In example aspects, the upper edge 222 may be positioned below the neckline edge 120 formed by the outer layer 134 and the inner layer 210.

The upper right portion 214 of the Y-shaped layer 212 is positioned generally above the first breast covering area 128 and may extend on to the right shoulder strap 124 and form at least part of an inner-facing surface of the right shoulder strap 124. The upper left portion 216 of the Y-shaped layer 212 is positioned generally above the second breast covering area 130 and may extend on to the left shoulder strap 124 and form at least part of an inner-facing surface of the left shoulder strap 124. The lower central portion 218 of the Y-shaped layer 212 is located at the central area 132 of the front portion 110 such that it is positioned between the first breast covering area 128 and the second breast covering area 130. In example aspects, a terminal end 219 of the lower central portion 218 may be affixed to the underband 126 and/or to the lower edge 122 of the front portion 110.

In example aspects, the Y-shaped layer 212 is formed from a mesh elastic material (a mesh material having a percentage of elastic yarns) that has stretch properties and a relatively high modulus of elasticity or a high degree of stretch resistance (known in the textile industry as "power mesh"). In example aspects, the Y-shaped layer 212 may have a stretch resistance that is greater than the stretch resistance of one or more of the inner layer 210 and the outer layer 134. Due to its relatively high stretch resistance, the Y-shaped layer is able to provide support and control to a wearer's breasts. For example, the upper right portion 214 and the upper left portion 216 may help to limit upward movement of a wearer's breasts. The lower central portion 218 of the Y-shaped layer 212 may act as an anchor to stabilize the upper right portion 214 and the upper left portion 216.

FIGS. 1 and 2 further depict features of the underband 126. The underband 126 extends from at least the lower edge 122 of the front portion 110 and generally encircles the support garment 100 and a wearer's torso when the support garment 100 is worn. In example aspects, the underband 126 may be zoned to have different areas with different degrees of air permeability and/or stretch. The placement of the areas with different air permeabilities may be based on, for example, heat and/or sweat maps of the human torso. For example, heat and/or sweat maps indicate that the central front area of the human torso may be a high heat and/or sweat producing area. Based on this, the underband 126 includes a first area 136 that is vertically aligned with the central area 132 of the front portion 110 of the support garment 100. The first area 136 terminates at a first lateral edge 138 and a second lateral edge 140 opposite the first lateral edge 138. In example aspects, the first lateral edge 138 and the second lateral edge 140 may include seamed edges, or the first lateral edge 138 and the second lateral edge 140 may comprise a hypothetical boundary demarcating the limits of the first area 136. In example aspects, the first area 136 may longitudinally extend from about 4 cm to about 10 cm although lengths above and below these values are contemplated herein.

In example aspects, the first area 136 may comprise a laminate construction including an outer layer 142 shown in FIG. 1 and a first mesh layer 223 shown in FIG. 2 that are laminated together using a breathable laminate film. In example aspects, the outer layer 142 may be the same material as the material that forms the outer layer 134 of the front portion 110. As such, the outer layer 142 may include a single-knit jersey material formed from polyester yarns and elastic yarns. In example aspects, the first mesh layer 223 may be a lightweight mesh material having a first degree of stretch resistance in the longitudinal direction (e.g., along the length of the underband 126). The first mesh layer 223 may include a large number of openings so that the first mesh layer 223 has a first degree of air permeability which allows heated air and/or moisture vapor produced by the wearer to travel away from the wearer's skin surface.

The underband 126 also includes a second area 146 that extends laterally away from the first lateral edge 138 and the second lateral edge 140 of the first area 136. In example aspects, the second area 146 may form a remaining portion of the underband 126. For example, the second area 146 may comprise a continuous band such that the support garment 100 is donned and doffed by pulling the support garment 100 over the wearer's head. In other example aspects, the second area 146 may terminate at a first terminal end and a second terminal end that can be coupled together to complete the underband 126.

The second area 146 may comprise a laminate construction including an outer layer 148 shown in FIG. 1 and a second mesh layer 224 shown in FIG. 2 that are laminated together using a breathable laminate film. The use of a breathable laminate film to adhere the materials together at the first area 136 and the second area 146 eliminates the need for stitching, which may reduce friction or chaffing points with a wearer's skin. In example aspects, the outer layer 148 may be the same material as the material that forms the outer layer 134 of the front portion 110, and/or the outer layer 142 of the first area 136. As such, the outer layer 148 may include a single-knit jersey material formed from polyester yarns and elastic yarns. In example aspects, the outer layer 142 of the first area 136 and the outer layer 148 of the second area 146 may comprise a continuous panel of material without seams. In other example aspects, the outer layer 142 of the first area 136 may be joined to the outer layer 148 of the second area 146 at seams located at the first lateral edge 138 and the second lateral edge 140 of the first area 136 as shown in FIG. 1.

In example aspects, the second mesh layer 224 may be a heavier weight mesh material having a second degree of stretch resistance in the longitudinal direction (e.g., along the length of the underband 126) that is less than the first degree of stretch resistance of the first mesh layer 223. Thus, the second area 146 may have a smaller degree of stretch resistance compared to the first area 136. This enables the second area 146 of the underband 126 to more easily stretch when donning and doffing the support garment 100 and further allows stretch during certain movements, including athletic movements. In example aspects, the second mesh layer 224 may have a second degree of air permeability that is less than the first degree of air permeability of the first area 136. The lower degree of air permeability in this area may reflect heat and/or sweat maps of the human torso that indicate, for example, that the side areas of the human torso may not produce as much heat and/or sweat as the center front of the human torso. As mentioned, the second mesh layer 224 may have a heavier weight as measured in grams per square meter than the first mesh layer 223.

Figure 3:
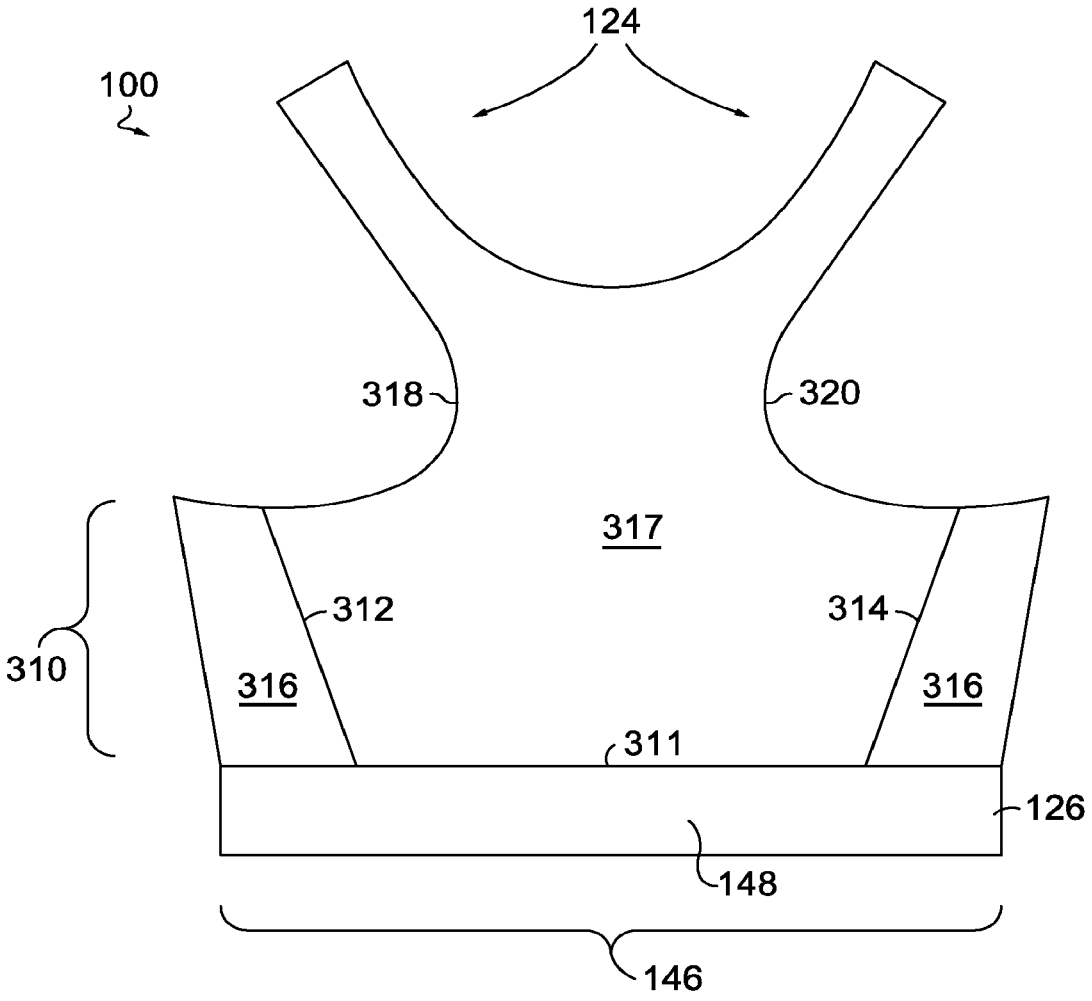
FIG. 3 illustrates a view of an outer-facing surface of a back portion of the support garment of FIG. 1 in accordance with aspects herein.
Figure 4:
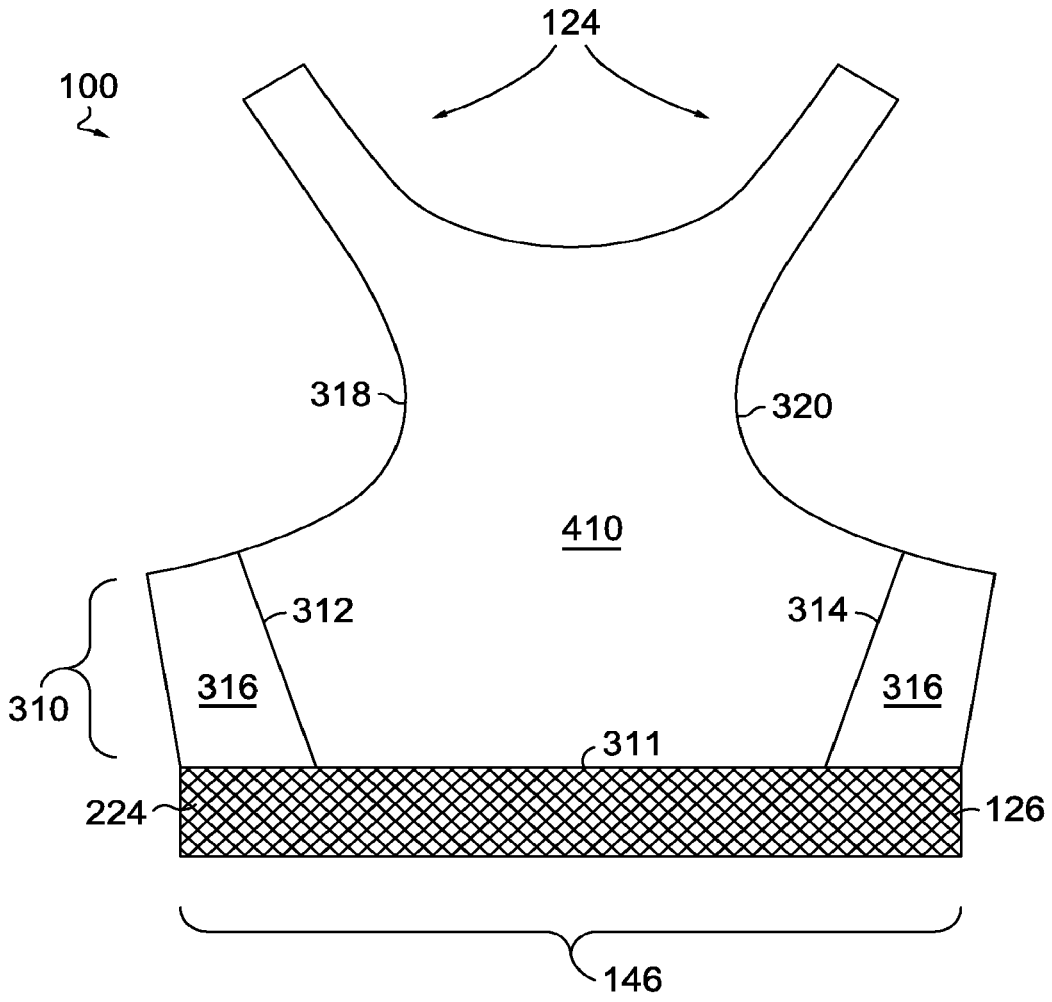
FIG. 4 illustrates a view of an inner-facing surface of the back portion of FIG. 3 in accordance with aspects herein.

FIG. 3 depicts a view of an outer-facing surface of a back portion 310 of the support garment 100, and FIG. 4 depicts a view of an inner-facing surface of the back portion 310. As shown, the back portion 310 extends from the shoulder straps 124 and includes a first armhole edge 318, a second armhole edge 320, and a lower edge 311 from which the underband 126 extends. The back portion 310 further extends between a first back lateral edge 312 and a second back lateral edge 314. The first and second back lateral edges 312 and 314 may comprise seamed edges. Alternatively, the first and second back lateral edges 312 and 314 may comprise hypothetical boundaries demarcating the limits of the back portion 310. FIGS. 3 and 4 further depict part of side portions 316 which will be described below. The underband 126 includes the second area 146 formed from the outer layer 148 as shown in FIG. 3 and the second mesh layer 224 as shown in FIG. 4.

In some example aspects, the back portion 310 may include a two-ply construction having an outer layer 317 shown in FIG. 3, and an inner layer 410 shown in FIG. 4. One or both of the outer layer 317 and the inner layer 410 may, in example aspects, comprise mesh materials for increased air permeability of the back portion 310. In some example aspects, at least one of the layers 317 and/or 410 may comprise an elastic mesh with a high degree of stretch resistance (e.g., a power mesh) to provide support in the back portion 310. In example aspects, one or more portions of the outer layer 317 and the inner layer 410 may optionally be affixed together using a film. Properties of the film may be varied to achieve different levels of support on the back portion 310. For example, a thicker film may be used to achieve a higher level of support at a lower part of the back portion 310 near to and/or parallel with the underband 126. Conversely, a thinner film may be used in the underarm area to achieve a lighter level of support in this area. Having a lighter level of support in the underarm area may decrease the chances of the wearer's skin and/or subdermal fat from extending over the underarm edge (so-called "muffin top"). Additionally or alternatively, a thicker adhesive layer used to bond the film to one or both of the outer layer 317 and/or the inner layer 410 may increase the level of support in lower part of the back portion 310. Conversely, a thinner adhesive layer may be used in the underarm area to achieve a lighter level of support in this area. In further example aspects, a dot lamination technique may be used to affix the film to one or both of the outer layer 317 and/or the inner layer 410. In this technique, the amount of dots of adhesive per unit area may be increased in the lower part of the back portion 310 to achieve a higher level of support. Conversely, the amount of dots of adhesive per unit area may be decreased in the underarm area to achieve a lighter level of support. Any and all aspects, and any variation thereof, are contemplated as being within the scope herein.

The configuration shown in FIGS. 3 and 4 is a racerback configuration with a continuous underband. This is just one example configuration and multiple different configurations for the back portion 310 are contemplated herein. For example, the back portion 310 may include a more traditional configuration where the shoulder straps 124 remain separate. In another example, the back portion 310 and/or the underband 126 may include terminal ends that can be joined together using different coupling mechanisms (e.g., hook-and-eye, hook-and-loop, and the like). Any and all aspects, and any variation thereof, are contemplated as being within the scope herein.

Figure 5:
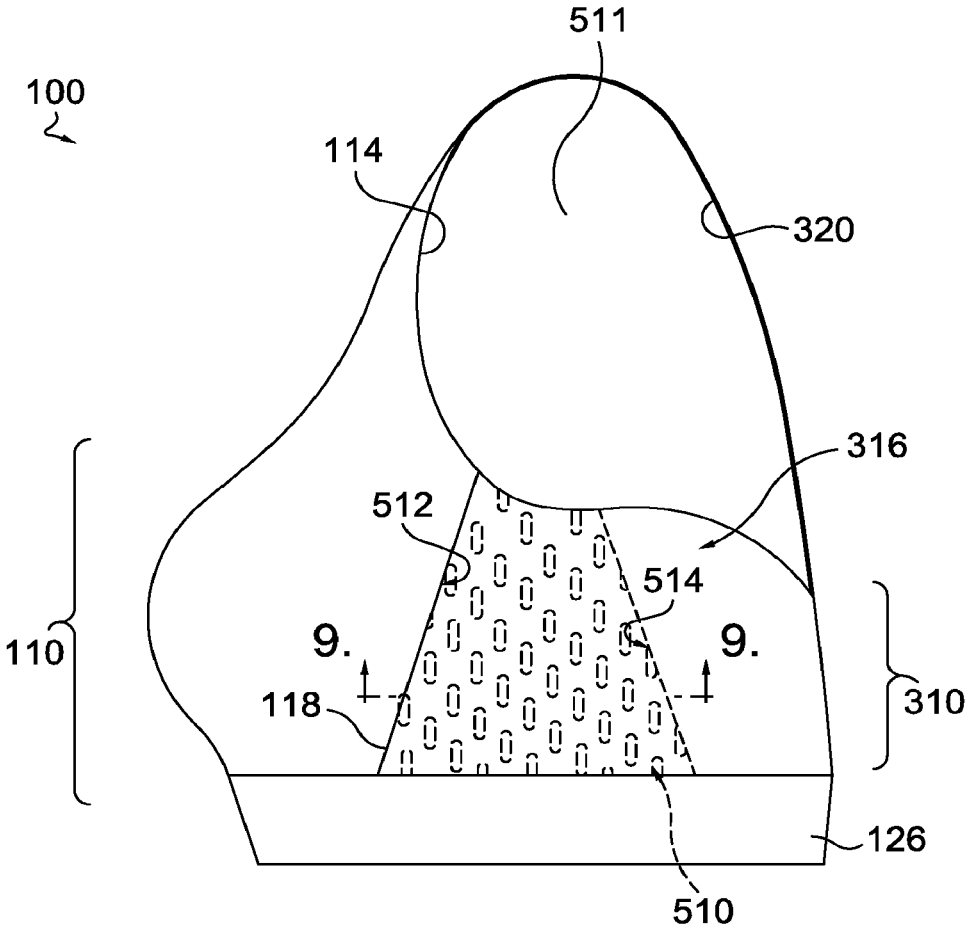
FIG. 5 illustrates a side view of the support garment of FIG. 1 in accordance with aspects herein.

FIG. 5 depicts a left side view of the support garment 100. A right side view of the support garment 100 would be a mirror image of the left side view. As such, the description of the left side view is equally applicable to the right side view of the support garment 100. The side portion 316 is shown extending between the front portion 110 and the back portion 310. More particularly, the side portion 316 extends between the second front lateral edge 118 of the front portion 110 and the second back lateral edge 314 of the back portion 310 (not seen in FIG. 5). In example aspects, the side portion 316 may comprise a separate panel piece that is affixed to the front portion 110 and the back portion 310 at seams corresponding to the second front lateral edge 118 of the front portion 110 and to the second back lateral edge 314 of the back portion 310. In other example aspects, the side portion 316 may comprise an integral extension of the material(s) forming the front portion 110 and/or the back portion 310 such that there are not seams demarcating the different portions of the support garment 100.

As shown, the side portion 316 includes a foam pad 510. The foam pad 510 is shown in dashed line to indicate it is positioned between layers of material forming the side portion 316 as further explained below. The foam pad 510 includes a leading edge 512 that abuts and/or is in contact with the second front lateral edge 118 of the front portion 110. The foam pad 510 further includes a trailing edge 514 that is spaced apart from the second front lateral edge 118 of the front portion 110. Further details of the side portion 316 and the foam pad 510 are described with respect to FIGS. 6A and 6B.

FIG. 5 further depicts a left side arm opening 511 which is formed by at least the second armhole edge 114 of the front portion 110, the second armhole edge 320 of the back portion 310, and an upper edge of the side portion 316. In example aspects, the layers of material forming the front portion 110, the side portion 316, and the back portion 310 may be laminated together at the edges forming the left side arm opening 511 and laser cut to form a clean edge without stitching. A similar construction method would be used for the right side arm opening.

Figure 6A:
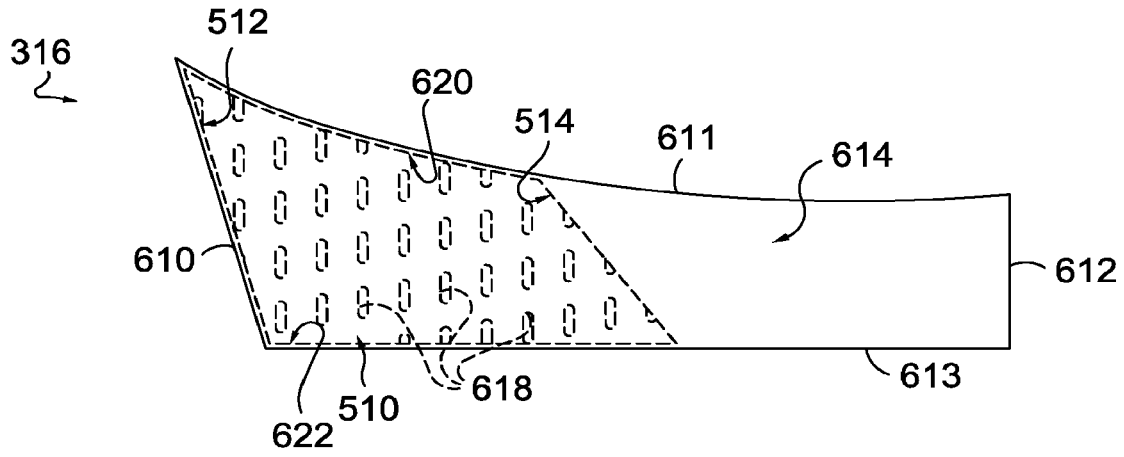
FIG. 6A illustrates an isolated view of an outer-facing surface of a side portion of the support garment of FIG. 1 in accordance with aspects herein.
Figure 6B:
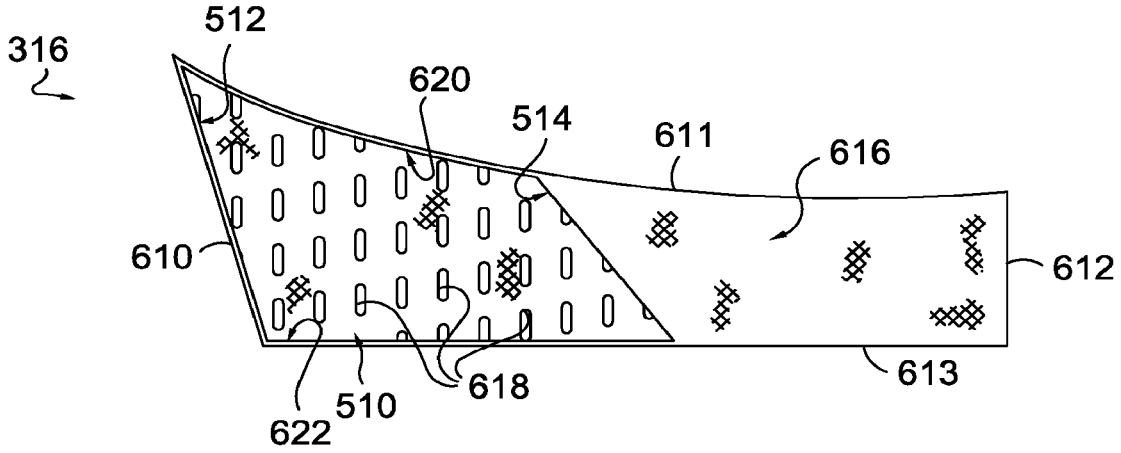
FIG. 6B illustrates a view of the inner-facing surface of the side portion of FIG. 6A in accordance with aspects herein.

FIG. 6A depicts an isolated view of an outer-facing surface of the side portion 316, and FIG. 6B depicts an isolated view of an inner-facing surface of the side portion 316. Although the side portion 316 is for a left side of the support garment 100, the discussion that follows is equally applicable to the side portion 316 for the right side of the support garment 100. FIGS. 6A and 6B depict the side portion 316 as a separate panel piece, but it is contemplated herein that the side portion 316 may comprise an integral extension of the front portion 110 and/or the back portion 310. The side portion 316 includes a leading edge 610 and a trailing edge 612. In example aspects, the leading edge 610 of the side portion 316 is seamed or affixed to the second front lateral edge 118 of the front portion 110, and the trailing edge 612 of the side portion 316 is seamed or affixed to the second back lateral edge 314 of the back portion 310 of the support garment 100. The side portion 316 also includes an upper edge 611 and a lower edge 613. The upper edge 611 helps to form, in part, the left side arm opening 511.

The side portion 316 may include an outer layer 614 shown in FIG. 6A and an inner mesh layer 616 shown in FIG. 6B. In example aspects, the outer layer 614 may be formed from the same material as used to form, for example, the outer layer 134 of the front portion 110. For instance, the outer layer 614 may be a single-knit jersey material formed from polyester yarns and elastic yarns. This is just one example, and it is contemplated herein that the outer layer 614 may be formed of other materials (e.g., other knit constructions, woven constructions, nonwoven constructions, other yarns, and the like). The foam pad 510 is shown in dashed line in FIG. 6A to indicate it is generally hidden from view by the outer layer 614. The use of a mesh material for the inner mesh layer 616 may help promote permeability and breathability of the side portion 316 when used in conjunction with the foam pad 510 as explained below. Due to the open structure of the inner mesh layer 616, the foam pad 510 is generally visible when viewed from the inner-facing surface of the side portion 316.

In example aspects, the foam pad 510 is positioned between the outer layer 614 and the inner mesh layer 616 of the side portion 316. The leading edge 512 of the foam pad 510 is positioned adjacent to and/or abuts the leading edge 610 of the side portion 316 and/or the second front lateral edge 118 of the front portion 110. The trailing edge 514 of the foam pad 510 is positioned at an approximate mid-point of a length of the side portion 316 and is spaced apart from the leading edge 610 of the side portion 316 and the second front lateral edge 118 of the front portion 110; it is also spaced apart from the trailing edge 612 of the side portion 316. Although the trailing edge 514 is shown as angled, it is contemplated herein that the trailing edge 514 may assume different configurations such as a vertically oriented edge, a curved edge, and the like. The foam pad 510 further includes an upper edge 620 that is aligned with or coincident with the upper edge 611 of the side portion 316 and a lower edge 622 that is aligned with or coincident with the lower edge 613 of the side portion 316. In example aspects, the outer layer 614 of the side portion 316 is laminated to the outer surface of the foam pad 510 using, for example, a laminate film and/or an adhesive layer to help maintain the foam pad 510 in a fixed position. Stitching or other affixation methods may optionally be used to further secure the foam pad 510. For example, the trailing edge 514 of the foam pad 510 may be stitched to one or more of the outer layer 614 and/or the inner mesh layer 616. In example aspects, the inner mesh layer 616 of the side portion 316 may not be laminated to the foam pad 510 to allow some movement between the two structures.

In example aspects, the foam pad 510 may have a uniform thickness from about 0.5 mm to about 2.5 mm, from about 0.75 mm to about 2.25 mm, or from about 1.0 mm to about 2.0 mm. The foam pad 510 may also include a plurality of apertures 618 that extend through the thickness of the foam pad 510. In example aspects, the plurality of apertures 618 are uniformly distributed across the surface of the foam pad 510 and may be a variety of shapes including circles, ovals, rectangles, squares, and the like. In example aspects, a length of an aperture 618 taken along its longest axis may be from about 0.25 mm to about 1.5 mm, from about 0.5 mm to about 1.0 mm, or about 0.75 mm. The uniformly thin profile of the foam pad 510 combined with the plurality of apertures 618 make the foam pad 510 lightweight and breathable. This, combined with the inner mesh layer 616 of the side portion 316 facilitates the removal of sweat and/or moisture vapor from a wearer's skin surface and improves wearer comfort. The placement of the foam pad 510 at the side portion 316 such that it is adjacent to the front portion 110 helps to limit lateral movement of a wearer's breasts during movement, but the thin profile of the foam pad 510 allows for some movement which improves wearer comfort.

Figure 7:
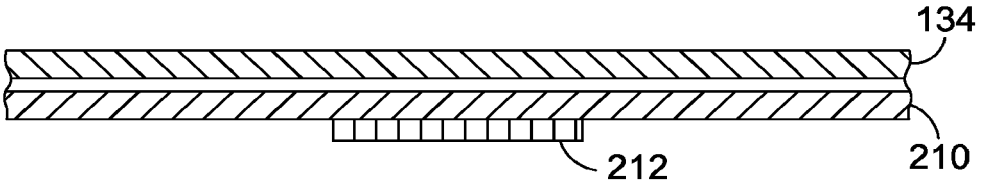
FIG. 7 illustrates a cross-section view taken at cut line 7-7 of FIG. 1 in accordance with aspects herein.

FIG. 7 depicts a cross-section taken at cut line 7-7 of FIG. 1 and illustrates the relationship between the different layers that form the front portion 110. As shown, the surfaces of the outer layer 134 and the inner layer 210 of the front portion 110 are unaffixed to each other (i.e., there is a space or void between the outer layer 134 and the inner layer 210) so that the outer layer 134 and the inner layer 210 may exhibit relative movement with respect to each other. The surface of the Y-shaped layer 212 is affixed to the inner surface of the inner layer 210 using, for example, a laminate film and/or an adhesive.

Figure 8:
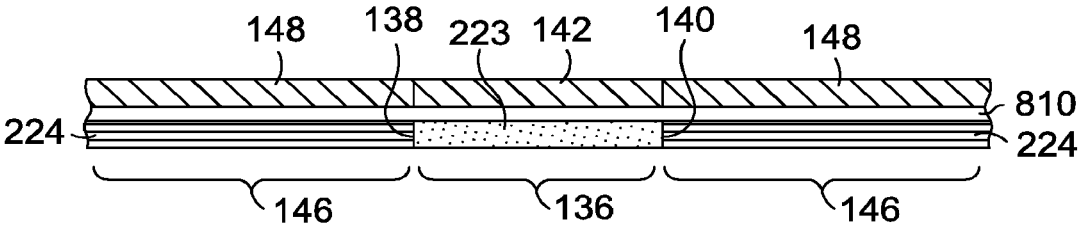
FIG. 8 illustrates a cross-section view taken at cut line 8-8 of FIG. 2 in accordance with aspects herein.

FIG. 8 depicts a cross-section taken at cut line 8-8 of FIG. 2 and illustrates the relationship between the different layers that form the first area 136 and the second area 146 of the underband 126. As shown, the first area 136 includes the outer layer 142 and the first mesh layer 223. The outer layer 142 and the first mesh layer 223 are affixed together using a breathable laminate film 810. The first area 136 is bounded by the first lateral edge 138 and the second lateral edge 140. The second area 146 includes the outer layer 148 and the second mesh layer 224. The outer layer 148 and the second mesh layer 224 are affixed together using the breathable laminate film 810. In example aspects, the outer layer 148 may integrally extend from the outer layer 142 such that there are not seamed areas. In other example aspects, the outer layer 142 may comprise a separate panel piece than the outer layer 148.

Figure 9:
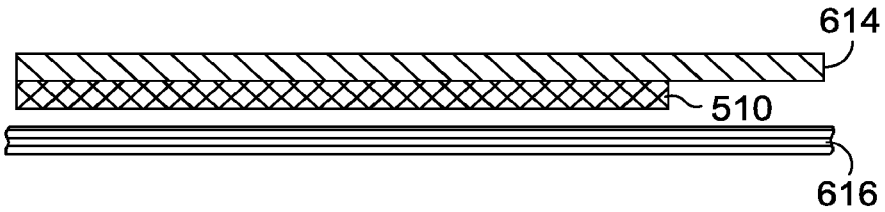
FIG. 9 illustrates a cross-section view taken at cut line 9-9 of FIG. 5 in accordance with aspects herein.

FIG. 9 depicts a cross-section taken at cut line 9-9 of FIG. 5 and illustrates the relationship between the different layers in the side portion 316 of the support garment 100. As shown, the side portion includes the outer layer 614, the inner mesh layer 616, and the foam pad 510. The foam pad 510 is positioned between the outer layer 614 and the inner mesh layer 616, and the outer layer 614 is affixed to the foam pad 510 using, for example, a laminate film or an adhesive in example aspects. In example aspects, the inner mesh layer 616 may be unaffixed from the foam pad 510 and/or the outer layer 614.

Figure 10:
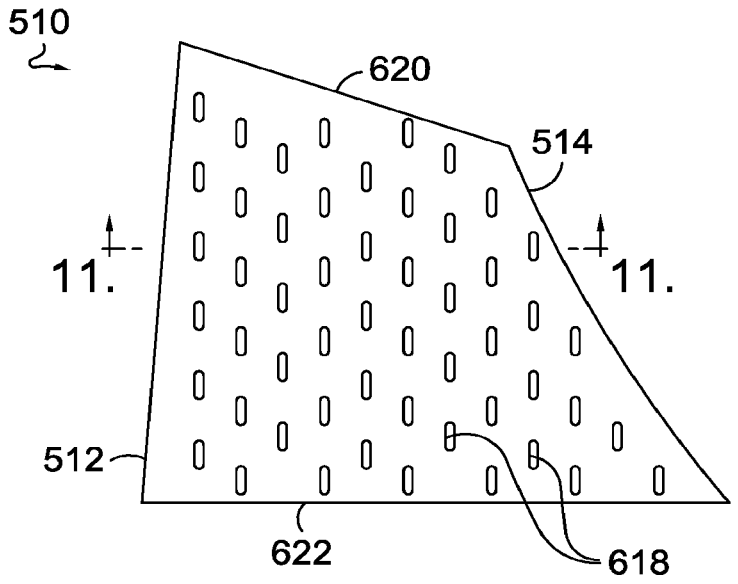
FIG. 10 illustrates an example foam pad for use in the support garment of FIG. 1 in accordance with aspects herein.
Figure 11:
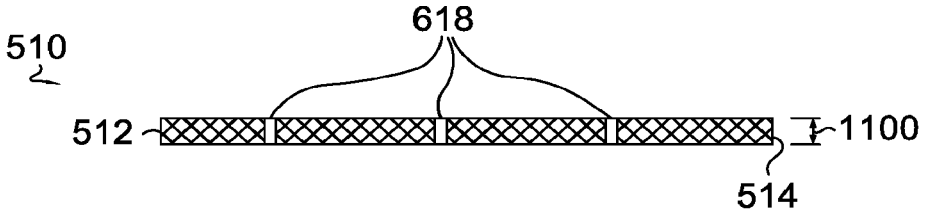
FIG. 11 illustrates a cross-section view taken at cut line 11-11 of FIG. 10 in accordance with aspects herein.

FIG. 10 illustrates an isolated view of the foam pad 510. The foam pad 510 has a perimeter shape defined by the leading edge 512, the trailing edge 514, the upper edge 620, and the lower edge 622. The foam pad 510 includes the plurality of apertures 618 uniformly distributed on the foam pad 510. As mentioned, it is contemplated herein that the foam pad 510 has a uniform thickness. This is shown in FIG. 11 which is a cross-section of the foam pad 510 taken along cut line 11-11 of FIG. 10. The foam pad 510 has a uniform thickness 1100. In example aspects, the thickness 1100 may be from about 0.5 mm to about 2.5 mm, from about 0.75 mm to about 2.25 mm, or from about 1.0 mm to about 2.0 mm. The apertures 618 are shown as extending through the thickness 1100 of the foam pad 510.

Figure 12:
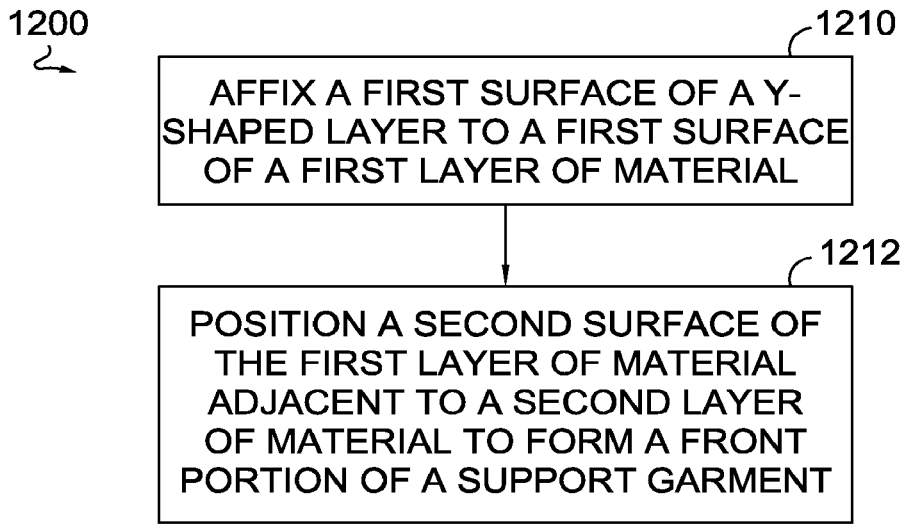
FIG. 12 illustrates a flow diagram of an example method of forming a support garment having a Y-shaped support layer in accordance with aspects herein.

FIG. 12 depicts a flow diagram of an example method 1200 of manufacturing a support garment configured to provide a high level of support to a wearer's breasts. At a step 1210, a first surface of a Y-shaped layer, such as the Y-shaped layer 212 of the support garment 100 is affixed to a first surface of a first layer of material, such as the inner layer 210 of the support garment 100. At a step 1212, a second surface of the first layer of material is positioned adjacent to a first surface of a second layer of material, such as the outer layer 134 of the support garment 100 to form a front portion, such as the front portion 110, of the support garment. In example aspects, a second surface of the second layer of material forms an outer-facing surface of the front portion, and the Y-shaped layer forms, at least in part, an innermost surface of the front portion of the support garment. In example aspects, the second layer of material is substantially unaffixed from the first layer of material except, for example, at one or more perimeter edges of the respective layers. In further example aspects, the stretch resistance of the Y-shaped layer is greater than the stretch resistance of one or both of the first layer of material and the second layer of material. The Y-shaped layer is thus configured to help limit upward movement of a wearer's breast when, for instance, the wearer is running.

Figure 13:
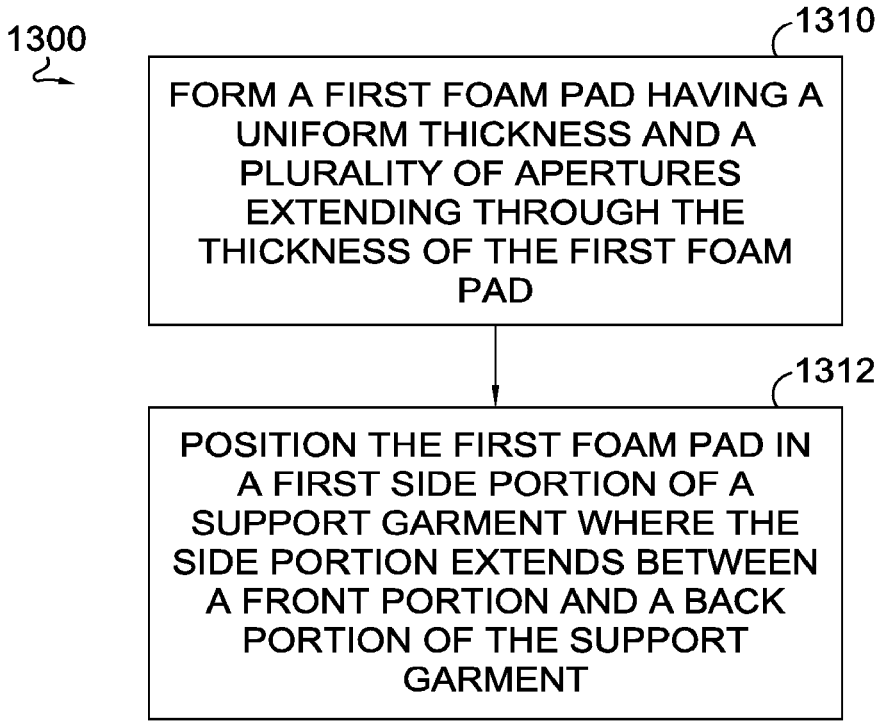
FIG. 13 illustrates a flow diagram of an example method of forming a support garment having a foam pad positioned at a side portion of the support garment in accordance with aspects herein.

FIG. 13 depicts a flow diagram of another example method 1300 of manufacturing a support garment that may be used by itself or in combination with the method 1200. At a step 1310, a first foam pad, such as the foam pad 510, is formed such that it has a uniform thickness and includes a plurality of apertures that extend through the thickness of the foam pad. In example aspects, the foam pad may be formed through an injection molding process where the plurality of apertures are formed in the molding process. In other example aspects, the plurality of apertures may be formed in a post-production step through, for example, laser cutting, die cutting, and the like. At a step 1312, the first foam pad is positioned in a first side portion, such as the side portion 316 of the support garment 100. The first side portion extends between a front portion, such as the front portion 110, and a back portion such as the back portion 310 of the support garment 100, and the foam pad is positioned such that a leading edge of the foam pad abuts a lateral edge of the front portion. The method 1300 may further include forming a second foam pad and positioning the second foam pad in a second side portion of the support garment. In example aspects, the first and second foam pads may be positioned between an outer layer, such as the outer layer 614, and an inner mesh layer such as the inner mesh layer 616. To help secure the foam pad, one or both of the outer layer or the inner mesh layer may be laminated to a respective surface of the foam pad 510.

Figure 14:
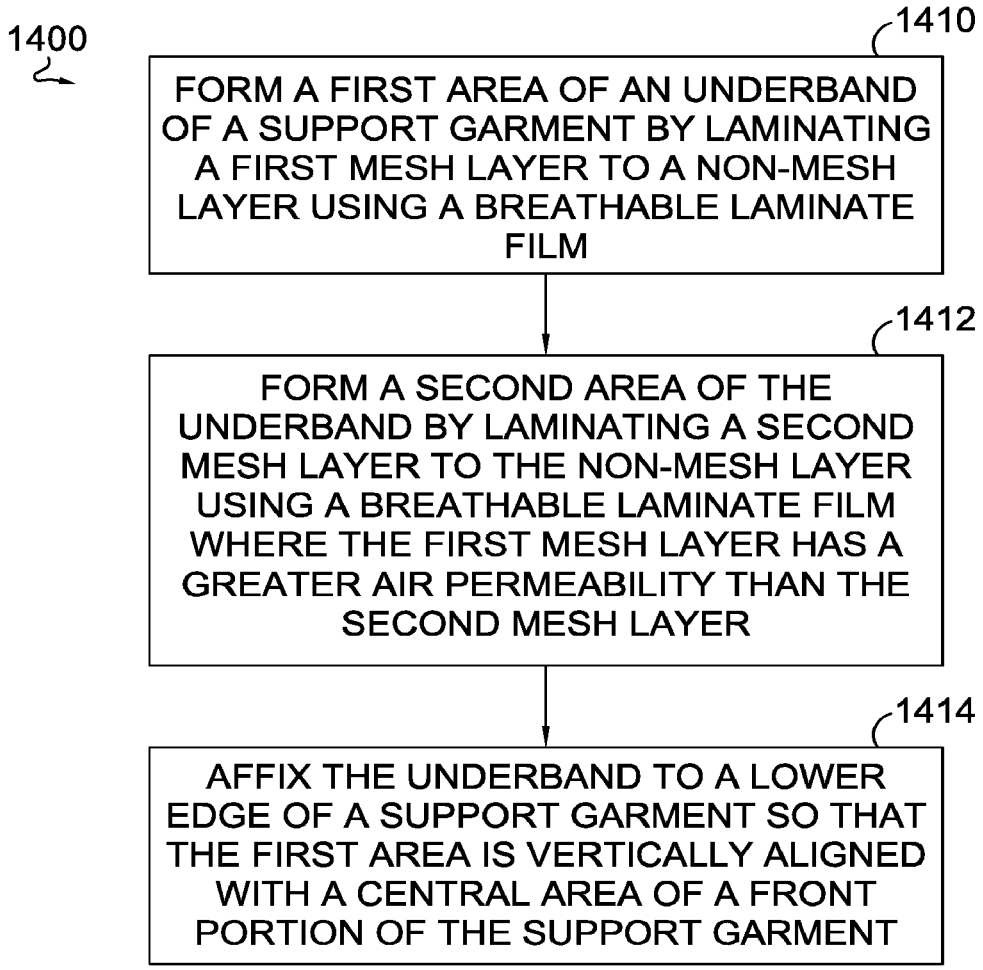
FIG. 14 illustrates a flow diagram of an example method of forming a support garment having an underband with different air permeability areas and different stretch areas in accordance with aspects herein.

FIG. 14 depicts a flow diagram of an example method 1400 of manufacturing a support garment having an underband. The method 1400 may be used by itself, in combination with the method 1300, in combination with the method 1200, or in combination with the methods 1200 and 1300. At a step 1410, a first area of an underband, such as the first area 136 of the underband 126, may be formed by laminating a first mesh layer such as the first mesh layer 223 to a non-mesh layer such as the outer layer 142 using a breathable laminate film such as the breathable laminate film 810. In example aspects, the first mesh layer may have a first degree of air permeability and a first degree of stretch resistance. At a step 1412, a second area, such as the second area 146 of the underband 126, is formed by laminating a second mesh layer such as the second mesh layer 224 to a non-mesh layer such as the outer layer 148 using a breathable laminate film such as the breathable laminate film 810. In example aspects, the second mesh layer has a second degree of air permeability that is less than the first degree of air permeability of the first mesh layer and a second degree of stretch resistance that is less than the first degree of stretch resistance of the first mesh layer. In example aspects, due to the difference in stretch resistance between the first mesh layer and the second mesh layer, the first area of the underband exhibits a greater resistance to stretch than the second area.

At a step 1414, the underband is affixed to a lower edge of a support garment such as the support garment 100 such that the first area is vertically aligned with a central area of a front portion of the support garment. In example aspects, the central area, such as the central area 132 of the front portion 110 is located between a first breast covering area and a second breast covering area of the support garment such as the first breast covering area 128 and the second breast covering area 130 of the support garment 100. In example aspects, the first area may extend in a lengthwise direction from about 4 cm to about 10 cm and may be demarcated by a first lateral edge and a second lateral edge. The second area extends laterally away from the first and second lateral edges of the first area and may form the remainder of the underband in example aspects.

The following clauses represent example aspects of concepts contemplated herein. Any one of the following clauses may be combined in a multiple dependent manner to depend from one or more other clauses. Further, any combination of dependent clauses (clauses that explicitly depend from a previous clause) may be combined while staying within the scope of aspects contemplated herein. The following clauses are illustrative in nature and are not limiting.

Clause 1. A support garment comprising: a front portion comprising: an outer layer continuously extending from a first armhole edge of the front portion to a second armhole edge of the front portion; an inner layer positioned interior to the outer layer, the inner layer continuously extending from the first armhole edge of the front portion to the second armhole edge of the front portion; and a Y-shaped layer positioned interior to the inner layer and affixed to the inner layer, the Y-shaped layer having an upper right portion, an upper left portion, and a lower central portion.

Clause 2. The support garment according to clause 1, wherein the outer layer comprises a single-knit jersey material.

Clause 3. The support garment according to any of clauses 1 through 2, wherein the outer layer is formed from polyester yarns and elastic yarns.

Clause 4. The support garment according to any of clauses 1 through 3, wherein the inner layer comprises a double-knit material.

Clause 5. The support garment according to any of clauses 1 through 4, wherein the inner layer is formed from nylon yarns and elastic yarns.

Clause 6. The support garment according to any of clauses 1 through 5, wherein the inner layer is substantially unaffixed from the outer layer.

Clause 7. The support garment according to any of clauses 1 through 6, wherein an entirety of the Y-shaped layer is affixed to the inner layer.

Clause 8. The support garment according to any of clauses 1 through 7, wherein a stretch resistance of the Y-shaped layer is greater than a stretch resistance of one or more of the inner layer and the outer layer.

Clause 9. The support garment according to any of clauses 1 through 8, wherein each of the upper right portion and the upper left portion of the Y-shaped layer are positioned superior to a respective breast covering area of the front portion.

Clause 10. The support garment according to any of clauses 1 through 9, wherein the lower central portion of the Y-shaped layer is located between the respective breast covering areas of the front portion.

Clause 11. A support garment comprising: a front portion comprising: an outer layer continuously extending from a first armhole edge of the front portion to a second armhole edge of the front portion; an inner layer positioned interior to the outer layer, the inner layer continuously extending from the first armhole edge of the front portion to the second armhole edge of the front portion, the inner layer substantially unaffixed from the outer layer; and a Y-shaped layer positioned interior to the inner layer and entirely affixed to the inner layer.

Clause 12. The support garment according to clause 11, wherein the outer layer continuously extends from a neckline edge to a lower edge of the front portion, and wherein the inner layer continuously extends from the neckline edge to the lower edge of the front portion.

Clause 13. The support garment according to any of clauses 11 through 12, wherein the outer layer comprises a single-knit jersey material.

Clause 14. The support garment according to any of clauses 11 through 13, wherein the inner layer comprises a double-knit material.

Clause 15. The support garment according to any of clauses 11 through 14, wherein each of the outer layer and the inner layer include elastic yarns.

Clause 16. The support garment according to any of clauses 11 through 15, wherein the Y-shaped layer has a right edge extending between an upper right portion and a lower central portion of the Y-shaped layer, and a left edge extending between an upper left portion and the lower central portion of the Y-shaped layer, wherein the right edge and the left edge converge as they extend toward the lower central portion.

Clause 17. The support garment according to any of clauses 11 through 16, wherein a stretch resistance of the Y-shaped layer is greater than a stretch resistance of one or more of the inner layer and the outer layer.

Clause 18. A method of manufacturing a support garment comprising: affixing a first surface of a Y-shaped layer to a first surface of a first layer of material, the Y-shaped layer having an upper right portion, an upper left portion, and a lower central portion; and positioning a second surface of the first layer of material adjacent to a first surface of a second layer of material to form a front portion of the support garment, wherein a second surface of the second layer of material forms an outer-facing surface of the front portion, and wherein the Y-shaped layer comprises at least in part an innermost surface of the front portion of the support garment.

Clause 19. The method of manufacturing the support garment according to clause 18, wherein the first layer of material is substantially unaffixed from the second layer of material.

Clause 20. The method of manufacturing the support garment according to any of clauses 18 through 19, wherein a stretch resistance of the Y-shaped layer is greater than a stretch resistance of one or more of the first layer of material and the second layer of material.

Clause 21. A support garment comprising: a front portion; a back portion; and a pair of side portions that extend between the front portion and the back portion, wherein each side portion of the pair of side portions includes a foam pad having a uniform thickness and a plurality of apertures extending through the thickness of the respective foam pad.

Clause 22. The support garment according to clause 21, wherein the front portion includes a first lateral edge and a second lateral edge opposite the first lateral edge, and wherein each of the foam pads includes a leading edge that abuts the respective first lateral edge and the second lateral edge of the front portion and a trailing edge that is spaced apart from the respective first lateral edge and the second lateral edge of the front portion.

Clause 23. The support garment according to clause 22, wherein each of the trailing edges of the foam pads is positioned at an approximate mid-point of a length of the respective side portion.

Clause 24. The support garment according to any of clauses 21 through 23, wherein the uniform thickness of the respective foam pad is from about 0.5 mm to about 2.5 mm.

Clause 25. The support garment according to any of clauses 21 through 24, wherein the plurality of apertures are uniformly distributed on the respective foam pad.

Clause 26. The support garment according to any of clauses 21 through 25, wherein each of the pair of side portions includes an upper edge and a lower edge, and wherein each of the foam pads includes an upper edge that aligns with the upper edge of the respective side portion and a lower edge that aligns with the lower edge of the respective side portion.

Clause 27. The support garment according to any of clauses 21 through 26, wherein each of the pair of side portions includes an inner mesh layer and an outer layer, and wherein the foam pads are positioned between the inner mesh layer and the outer layer.

Clause 28. The support garment according to clause 27, wherein the outer layer of the pair of side portions is affixed to an outer-facing surface of the respective foam pad.

Clause 29. The support garment according to any of clauses 27 through 28, wherein the inner mesh layer is unaffixed from an inner-facing surface of the respective foam pad.

Clause 30. A support garment comprising: a front portion having a first lateral edge and a second lateral edge opposite the first lateral edge; a back portion; and a first side portion that extends between the first lateral edge of the front portion and the back portion, the first side portion including a first foam pad, the first foam pad having a leading edge that abuts the first lateral edge of the front portion and a trailing edge that is spaced apart from the first lateral edge of the front portion; and a second side portion that extends between the second lateral edge of the front portion and the back portion, the second side portion including a second foam pad, the second foam pad having a leading edge that abuts the second lateral edge of the front portion and a trailing edge that is spaced apart from the second lateral edge of the front portion, wherein each of the first foam pad and the second foam pad have a uniform thickness.

Clause 31. The support garment according to clause 30, wherein each of the first foam pad and the second foam pad includes a plurality of apertures that extend through the thickness of the first foam pad and the second foam pad.

Clause 32. The support garment according to clause 31, wherein the plurality of apertures are uniformly distributed on the first foam pad and the second foam pad.

Clause 33. The support garment according to any of clauses 30 through 32, wherein the trailing edge of the first foam pad is positioned at an approximate mid-point of a length of the first side portion, and wherein the trailing edge of the second foam pad is positioned at an approximate mid-point of a length of the second side portion.

Clause 34. The support garment according to any of clauses 30 through 33, wherein each of the first side portion and the second side portion includes an inner mesh layer and an outer layer, and wherein each of the first foam pad and the second foam pad is positioned between the inner mesh layer and the outer layer.

Clause 35. The support garment according to clause 34, wherein the outer layer of each of the first side portion and the second side portion is affixed to an outer-facing surface of the respective first foam pad and the second foam pad, and wherein the inner mesh layer of each of the first side portion and the second side portion is unaffixed from an inner-facing surface of the respective first foam pad and the second foam pad.

Clause 36. The support garment according to any of clauses 30 through 35, wherein each of the first side portion and the second side portion includes an upper edge and a lower edge, and wherein each of the first foam pad and the second foam pad includes an upper edge that is aligned with the upper edge of the respective first side portion and the second side portion and a lower edge that is aligned with the lower edge of the respective first side portion and the second side portion.

Clause 37. A method of manufacturing a support garment comprising: forming a first foam pad having a uniform thickness and a plurality of apertures extending through the thickness of the first foam pad; and positioning the first foam pad in a first side portion of the support garment, the first side portion extending between a front portion and a back portion of the support garment.

Clause 38. The method of manufacturing the support garment according to clause 37, further comprising: forming a second foam pad having a uniform thickness and a plurality of apertures extending through the thickness of the second foam pad; and positioning the second foam pad in a second side portion of the support garment, the second side portion extending between the front portion and the back portion of the support garment.

Clause 29. The method of manufacturing the support garment according to clause 38, wherein the first foam pad and the second foam pad are each positioned between an inner mesh layer and an outer layer of the respective first side portion and the second side portion.

Clause 40. The method of manufacturing the support garment according to clause 39, further comprising laminating the outer layer to the respective first foam pad and the second foam pad.

Clause 41. A support garment comprising: a front portion having a first breast covering area, a second breast covering area, and a central area positioned between the first breast covering area and the second breast covering area; a back portion; a pair of side portions extending between the front portion and the back portion; and an underband extending from a lower edge of the front portion, the back portion, and the pair of side portions, the underband comprising: a first area vertically aligned with the central area of the front portion and terminating at a first lateral edge and a second lateral edge opposite the first lateral edge; the first area comprising an outer layer and a first mesh layer positioned interior to the outer layer, the first mesh layer having a first degree of air permeability, and a second area extending laterally away from the first lateral edge and the second lateral edge of the first area, the second area comprising an outer layer and a second mesh layer positioned interior to the outer layer, the second mesh layer having a second degree of air permeability that is less than the first degree of air permeability.

Clause 42. The support garment according to clause 41, wherein the first area has a first degree of stretch resistance in a lengthwise direction and the second area has a second degree of stretch resistance in the lengthwise direction, the second degree of stretch resistance less than the first degree of stretch resistance.

Clause 43. The support garment according to any of clauses 41 through 42, wherein the outer layer of the first area and the second area comprises a single knit construction.

Clause 44. The support garment according to clause 43, wherein the single knit construction is formed from polyester yarns and elastomeric yarns.

Clause 45. The support garment according to any of clauses 41 through 44, wherein the first area extends in a lengthwise direction from about 4 cm to about 10 cm.

Clause 46. The support garment according to any of clauses 41 through 45, wherein the second area forms a remaining portion of the underband.

Clause 47. The support garment according to any of clauses 41 through 46, wherein the first mesh layer has a lighter weight as measured in grams per square meter than the second mesh layer.

Clause 48. The support garment according to any of clauses 41 through 47, wherein the first area includes a breathable laminate film positioned between the outer layer and the first mesh layer, the breathable laminate film affixed to the outer layer and the first mesh layer.

Clause 49. The support garment according to any of clauses 41 through 48, wherein the second area includes a breathable laminate film positioned between the outer layer and the second mesh layer, the breathable laminate film affixed to the outer layer and the second mesh layer.

Clause 50. A support garment comprising: a first breast covering area, a second breast covering area, and a central area positioned between the first breast covering area and the second breast covering area; and an underband extending from a lower edge of the support garment, the underband comprising: a first area vertically aligned with the central area of the support garment and terminating at a first lateral edge and a second lateral edge opposite the first lateral edge, the first area having a first degree of air permeability and a first degree of stretch resistance in a longitudinal direction, and a second area extending laterally away from the first lateral edge and the second lateral edge of the first area, the second area having a second degree of air permeability that is less than the first degree of air permeability and a second degree of stretch resistance in the longitudinal direction that is less than the first degree of stretch resistance.

Clause 51. The support garment according to clause 50, wherein the first area includes an outer layer and a first mesh layer positioned interior to the outer layer.

Clause 52. The support garment according to clause 51, wherein the first area further includes a breathable laminate film positioned between the outer layer and the first mesh layer, the breathable laminate film affixed to the outer layer and the first mesh layer.

Clause 53. The support garment according to any of clauses 50 through 52, wherein the second area includes an outer layer and a second mesh layer positioned interior to the outer layer.

Clause 54. The support garment according to clause 53, wherein the second area further includes a breathable laminate film positioned between the outer layer and the second mesh layer, the breathable laminate film affixed to the outer layer and the second mesh layer.

Clause 55. The support garment according to any of clauses 51 through 54, wherein the outer layer in the first area and the outer layer in the second area each comprise the same fabric construction.

Clause 56. The support garment according to any of clauses 51 through 55, wherein the first mesh layer has a lighter weight as measured in grams per square meter than the second mesh layer.

Clause 57. A method of manufacturing a support garment having an underband, the method comprising: forming a first area of the underband by laminating a first mesh layer to a non-mesh layer using a breathable laminate film, the first mesh layer having a first degree of air permeability; forming a second area of the underband by laminating a second mesh layer to the non-mesh layer using a breathable laminate film, the second mesh layer having a second degree of air permeability that is less than the first degree of air permeability; and affixing the underband to a lower edge of the support garment so that the first area is vertically aligned with a central area of a front portion of the support garment, wherein the central area is positioned between a first breast covering area and a second breast covering area of the front portion of the support garment.

Clause 58. The method of manufacturing the support garment having the underband according to clause 57, wherein the first area extends between a first lateral edge and a second lateral edge opposite the first lateral edge, and wherein the second area extends laterally away from the first lateral edge and the second lateral edge of the first area.

Clause 59. The method of manufacturing the support garment having the underband according to any of clauses 57 through 58, wherein the first area extends in a lengthwise direction from about 4 cm to about 10 cm.

Clause 60. The method of manufacturing the support garment having the underband according to any of clauses 57 through 60, wherein the first area has a first degree of stretch resistance in a lengthwise direction and the second area has a second degree of stretch resistance in the lengthwise direction, the second degree of stretch resistance less than the first degree of stretch resistance.

Aspects of the present disclosure have been described with the intent to be illustrative rather than restrictive. Alternative aspects will become apparent to those skilled in the art that do not depart from its scope. A skilled artisan may develop alternative means of implementing the aforementioned improvements without departing from the scope of the present disclosure.

It will be understood that certain features and subcombinations are of utility and may be employed without reference to other features and subcombinations and are contemplated within the scope of the claims. Not all steps listed in the various figures need be carried out in the specific order described.

The invention claimed is:

1. A support garment comprising:

a front portion comprising:

a first layer continuously extending from a first armhole edge of the front portion to a second armhole edge of the front portion; and a Y-shaped layer positioned interior to the first layer and affixed to the first layer, the Y-shaped layer comprising an innermost layer of the support garment, the Y-shaped layer having an outer surface that abuts the first layer, wherein an entirety of the outer surface of the Y-shaped layer is affixed directly to the first layer, wherein the Y-shaped layer includes an upper right edge that is positioned at the first armhole edge, an upper left edge that is positioned at the second armhole edge, and a lower central region where the Y-shaped layer converges from the upper right edge and the upper left edge.

2. The support garment of claim 1, wherein the first layer comprises a double-knit material.

3. The support garment of claim 1, wherein the first layer is formed from nylon yarns and elastic yarns.

4. The support garment of claim 1, wherein an entirety of the Y-shaped layer is affixed to the first layer by one or more of a bonding, lamination, or adhesive process.

5. The support garment of claim 1, wherein a face of the first layer is oriented towards a second layer, and is detached from the second layer, such that the face is freely moveable relative to the second layer.

6. The support garment of claim 5, wherein the second layer comprises a single-knit jersey material.

7. The support garment of claim 5, wherein the second layer is formed from polyester yarns and elastic yarns.

8. The support garment of claim 5, wherein a stretch resistance of the Y-shaped layer is greater than a stretch resistance of one or more of the first layer and the second layer.

9. The support garment of claim 1, wherein:

the Y-shaped layer has a right edge extending between the upper right portion and the lower central portion of the Y-shaped layer, and a left edge extending between the upper left portion and the lower central portion of the Y-shaped layer, wherein the right edge and the left edge converge as they extend toward the lower central portion.

10. The support garment of claim 9, wherein the lower central portion of the Y-shaped layer is located between breast covering areas of the front portion.

11. A support garment comprising:

a front portion comprising:

a first layer; and a Y-shaped layer positioned interior to the first layer, the Y-shaped layer comprising an innermost layer of the support garment and comprising an outer surface that abuts the first layer, wherein the Y-shaped layer includes an upper right edge that is positioned at a first armhole edge, an upper left edge that is positioned at a second armhole edge, and a lower central region where the Y-shaped layer converges from the upper right edge and the upper left edge, and wherein an entirety of the outer surface of the Y-shaped layer is affixed directly to the first layer.

12. The support garment of claim 11, further comprising:

a second layer continuously extending from a first armhole edge of the front portion to a second armhole edge of the front portion; and wherein the first layer is positioned interior to the second layer, the first layer continuously extending from the first armhole edge of the front portion to the second armhole edge of the front portion, the first layer being unaffixed from the second layer.

13. The support garment of claim 12, wherein the second layer continuously extends from a neckline edge to a lower edge of the front portion, and wherein the first layer continuously extends from the neckline edge to the lower edge of the front portion.

14. The support garment of claim 12, wherein the second layer comprises a single-knit jersey material.

15. The support garment of claim 11, wherein the first layer comprises a double-knit material.

16. The support garment of claim 11, wherein each of the second layer and the first layer include elastic yarns.

17. The support garment of claim 11, wherein the Y-shaped layer has a right edge extending between an upper right portion and a lower central portion of the Y-shaped layer, and a left edge extending between an upper left portion and the lower central portion of the Y-shaped layer, wherein the right edge and the left edge converge as they extend toward the lower central portion.

18. The support garment of claim 11, wherein a stretch resistance of the Y-shaped layer is greater than a stretch resistance of one or more of the first layer and the second layer.

19. A support garment comprising:

a front portion comprising:

a second layer continuously extending from a second armhole edge of the front portion to a first armhole edge of the front portion;

a first layer positioned interior to the second layer, the first layer continuously extending from the first armhole edge of the front portion to the second armhole edge of the front portion; and a Y-shaped layer positioned interior to the first layer and affixed to the first layer, the Y-shaped layer comprising an innermost layer of the support garment and having an outer surface that abuts the first layer, wherein an entirety of the outer surface of the Y-shaped layer is affixed directly to the first layer, wherein the Y-shaped layer includes an upper right edge that is positioned at the first armhole edge, an upper left edge that is positioned at the second armhole edge, and a lower central region where the Y-shaped layer converges from the upper right edge and the upper left edge.

20. The support garment of claim 19, wherein the Y-shaped layer comprises a power mesh textile and defines an innermost surface of the support garment, wherein the Y-shaped layer comprises an outer surface that abuts the first layer, and wherein an entirety of the outer surface of the Y-shaped layer is affixed to the first layer.

* * * * *